US008890752B2

(12) United States Patent
Song et al.

(10) Patent No.: US 8,890,752 B2
(45) Date of Patent: Nov. 18, 2014

(54) RECONFIGURABLE ANTENNA

(75) Inventors: Peter Chun Teck Song, Birmingham (GB); Peter Hall, Birmingham (GB); James Robert Kelly, Sheffield (GB)

(73) Assignee: The University of Birmingham, Birmingham (GB)

( * ) Notice: Subject to any disclaimer, the term of this patent is extended or adjusted under 35 U.S.C. 154(b) by 278 days.

(21) Appl. No.: 13/503,111

(22) PCT Filed: Oct. 18, 2010

(86) PCT No.: PCT/GB2010/001918

§ 371 (c)(1), (2), (4) Date: Jun. 18, 2012

(87) PCT Pub. No.: WO2011/048357

PCT Pub. Date: Apr. 28, 2011

(65) Prior Publication Data

US 2012/0242558 A1 Sep. 27, 2012

(30) Foreign Application Priority Data

Oct. 21, 2009 (GB) ..... 0918477.1

(51) Int. Cl.

| | |
|---|---|
| ***H01Q 1/38*** | (2006.01) |
| ***H01Q 5/00*** | (2006.01) |
| ***H01Q 9/42*** | (2006.01) |
| ***H01Q 9/40*** | (2006.01) |
| ***H01Q 1/24*** | (2006.01) |

(52) U.S. Cl.

CPC ..... *H01Q 1/243* (2013.01); *H01Q 5/0065* (2013.01); *H01Q 5/0072* (2013.01); *H01Q 9/42* (2013.01); *H01Q 9/40* (2013.01)

USPC ..... 343/700 MS; 343/702; 343/853; 343/860

(58) Field of Classification Search

CPC ... H01Q 1/243; H01Q 5/0065; H01Q 5/0072; H01Q 9/40; H01Q 9/42

USPC ..... 343/702, 745, 850, 852, 853, 860, 343/700 MS

See application file for complete search history.

(56) References Cited

U.S. PATENT DOCUMENTS

| | | | | |
|---|---|---|---|---|
| 5,784,032 | A * | 7/1998 | Johnston et al. | 343/702 |
| 7,663,555 | B2 * | 2/2010 | Caimi et al. | 343/702 |
| 7,864,133 | B2 * | 1/2011 | Rofougaran | 343/861 |

(Continued)

FOREIGN PATENT DOCUMENTS

| | | |
|---|---|---|
| EP | 1496564 | 1/2005 |
| EP | 1160999 | 10/2005 |

(Continued)

OTHER PUBLICATIONS

International Search Report issued in Int'l Pat. Appl. No. PCT/GB2010/001918, Dated Feb. 2, 2011.

(Continued)

*Primary Examiner* — Tho G Phan

(74) *Attorney, Agent, or Firm* — Barnes & Thornburg LLP

(57) ABSTRACT

A reconfigurable antenna comprises two or more mutually coupled radiating elements and two or more impedance-matching circuits configured for independent tuning of the frequency band of each radiating element. In addition, each radiating element is arranged for selective operation in each of the following states: a driven state, a floating state and a ground state.

18 Claims, 8 Drawing Sheets

(56) References Cited

U.S. PATENT DOCUMENTS

| | | | | |
|---|---|---|---|---|
| 8,232,925 | B2 * | 7/2012 | Knudsen et al. | 343/702 |
| 2005/0078047 | A1 | 4/2005 | Chiang et al. | |
| 2005/0156797 | A1 | 7/2005 | Chiang et al. | |
| 2007/0222697 | A1 | 9/2007 | Caimi et al. | |
| 2010/0022197 | A1 * | 1/2010 | Kato et al. | 455/75 |

FOREIGN PATENT DOCUMENTS

| | | |
|---|---|---|
| EP | 1804335 | 7/2007 |
| EP | 1876671 | 1/2008 |
| EP | 2117075 | 11/2009 |
| JP | 2003133828 | 5/2003 |
| WO | WO 2005/099040 | 10/2005 |
| WO | WO 2007/042615 | 4/2007 |

OTHER PUBLICATIONS

Search Report Issued in Patent Application No. GB0918477.1 on Feb. 5, 2010.

* cited by examiner

RECONFIGURABLE ANTENNA

CROSS REFERENCE TO RELATED APPLICATIONS

This application is a U.S. nationalization under 35 U.S.C. §371 of International Application No. PCT/GB2010/001918, filed Oct. 18, 2009, which claims priority to United Kingdom Application No. 0918477.1, filed Oct. 21, 2009. The disclosures set forth in the foregoing applications are incorporated herein by reference in their entireties.

FIELD OF THE INVENTION

The invention relates to a reconfigurable antenna. Particularly, but not exclusively, the invention relates to a reconfigurable antenna for use in a portable electronic device such as a mobile telephone, laptop, personal digital assistant (PDA) or radio.

BACKGROUND TO THE INVENTION

There is a growing demand for multifunctional devices that are capable of transmitting and/or receiving wireless signals for a number of different applications operating over a number of different frequency bands. For example, mobile devices are often required to operate in a number of countries, each employing different communication frequencies and standards. Furthermore, the device may require access to multiple wireless services such as penta-band cellular services, GPS, Bluetooth, WiFi, DVB-H, UWB, AM/FM/DAB radio reception and wireless internet access. Traditionally, this means that a number of different antennas are required with corresponding circuitry and this has significant implications on the overall dimensions of the device, its shape and industrial design—these features being of considerable importance to an end user.

Several Cognitive Radio (CR) system architectures have been proposed which may help to overcome some of these challenges. In particular, Spectrum Sensing Cognitive Radio (SSCR) has been proposed with the aim of providing an improved and more reliable service by making more efficient use of the frequency spectrum. It is envisaged that a CR device would change its communication frequency whenever necessary—for example, to avoid interference and spectrum "traffic jams" or when more bandwidth is needed such as to send a video clip. It has therefore been proposed that a CR device would be configured to operate in the following two modes:

- A 'Listening' mode, where the radio monitors the airspace for available spectrums/channels—an Ultra Wide-Band (UWB) antenna has been proposed for performing this listening/sensing function; and
- An 'Application' mode, where the service requested by an application determines the frequency or bandwidth requirements of the device—for example, in current mobile communication systems, a high data rate service such as video call may be routed via High Speed Downlink Packet Access (HSDPA) using several channels. Thus, at least one frequency reconfigurable narrowband antenna will likely be required for performing the application function.

However, as above, the space available for these antennas and their supporting circuitry will be limited in a portable CR device.

It will be understood that the term Ultra Wide-Band (UWB) is used throughout to denote a relatively large frequency range and is not limited to a specific range of frequencies such as those defined as UWB by the US Federal Communications Commission (FCC).

From the above, it will be apparent that tuneable antenna technology is a key requirement for an effective CR device as well as an enabling technology for advances in other mobile devices. Tuneable antennas will not only save space but will also enable devices to sense a user's interaction, environmental conditions and network requirements, and to reconfigure the antenna accordingly to maximise radiation performance. However, in conventional designs, it has been found that an antenna's frequency tuning range is often limited due to its physical dimensions.

It is therefore an aim of the present invention to provide a reconfigurable antenna which helps to address the above-mentioned problems.

SUMMARY OF THE INVENTION

According to a first aspect of the present invention there is provided a reconfigurable antenna comprising two or more mutually coupled radiating elements and two or more impedance-matching circuits configured for independent tuning of the frequency band of each radiating element; and wherein each radiating element is arranged for selective operation in each of the following states: a driven state, a floating state and a ground state.

The first aspect of the present invention therefore provides an antenna capable of generating at least two independently tuneable resonances wherein further tunability is achieved by selecting the appropriate state of each of the mutually coupled radiating elements. Accordingly, the present antenna configuration allows tremendous flexibility which can benefit manufacturers and service providers, as well as users, by providing them with an ability to configure the operational mode of the antenna. It will be understood that the present invention facilitates dynamic use of the radiating elements by selection of the desired operating state. More specifically, each radiating element can be active (i.e. driven by its associated impedance-matching circuit) or passive (i.e. with no electrical connection to its impedance-matching circuit so that its resonance frequency may float). Alternatively, each radiating element may be tied to a ground state (i.e. a reference voltage of approximately zero volts).

Embodiments of the present invention may cater for a wide range of frequencies. For example, an antenna according to an embodiment of the present invention which is configured for use in a mobile telephone might be capable of tuning between 470 and 3000 MHz. Such an antenna could support Wifi, Bluetooth, GPS, MediaFlo, DVB-H, LTE and other software-defined radio standards.

The present invention also allows for a simple and compact antenna construction, making it ideal for use in portable devices such as mobile telephones. In fact, the Applicants believe that embodiments of the present invention can be configured as penta-band cellular antennas having dimensions similar to (if not smaller than) current conventional tri-band or quad-band antennas.

At least one of the radiating elements may be constituted by a non-resonant resonator. In a particular embodiment, two non-resonant resonators are employed.

Each radiating element may be configured to operate over a wideband and/or a narrowband range of frequencies.

In a particular embodiment, each impedance-matching circuit may comprise a wideband tuning circuit and a narrowband tuning circuit.

In one embodiment, the antenna is provided on a substrate having a ground plane printed on a first side thereof. A first radiating element may be provided on the second side of the substrate, opposite to the first side, and laterally spaced from the ground plane. The first radiating element may be constituted by a microstrip patch, which may be planar or otherwise. In a specific embodiment, the first radiating element may be constituted by an L-shaped microstrip patch, having a planar portion and a portion orthogonal to the ground plane. The orthogonal portion may extend from an edge of the planar portion furthest from the ground plane such that the orthogonal portion is spaced from the ground plane by a so-called first gap.

A second radiating element may be constituted by a microstrip patch, which may be planar or otherwise. In a particular embodiment, the second radiating element is constituted by a planar microstrip patch, orthogonal to the ground plane. The second radiating element may be located between the ground plane and the orthogonal portion of the first radiating element (i.e. within the first gap). The distance between the ground plane and the second radiating element will form a so-called second gap. It will be understood that, in this embodiment, the distance between the second radiating element and the orthogonal portion of the first radiating element will determine the amount of mutual coupling therebetween. This distance will therefore be referred to throughout as the mutual gap.

The shape of each radiating element is not particularly limited and may be, for example, square, rectangular, triangular, circular, elliptical, annular, star-shaped or irregular. Furthermore, each radiating element may include at least one notch or cut-out. It will be understood that the shape and configuration of each radiating element will depend upon the desired characteristics of the antenna for the applications in question.

Similarly, the size and shape of the ground plane may be varied to provide the optimum characteristics for all modes of the operation. Accordingly, the first ground plane may be, for example, square, rectangular, triangular, circular, elliptical, annular or irregular. Furthermore, the ground plane may include at least one notch or cut-out.

Each radiating element may have an associated feed port. Each feed port may be connected to a control module comprising a control means for selecting the operating state of the associated radiating element. The control means may comprise a switch selectively configured to allow the radiating element to float, to be connected to the ground plane or to be driven by its associated impedance-matching circuit.

In the above embodiment, a first feed port may be provided between the first radiating element and a first control module having a first impedance-matching circuit and a second feed port may be provided between the second radiating element and a second control module having a second impedance-matching circuit.

The first feed port may be positioned in the centre of the radiating element or off-centre (i.e. closer to one side of the radiating element than the other).

In a specific embodiment, the first feed port may be located approximately one third of the distance along the length of the first radiating element. This is advantageous in that it causes non-symmetrical current to be generated along the ground plane thereby supporting many different resonances. It also enables the first radiating element to generate more resonances due to it having a different electrical length in each direction. In addition, positioning the first feed port off-centre allows more space for the second radiating element to be positioned close to the first radiating element which, in turn, results in a better coupling between the two radiating elements.

The first feed port may be connected to the ground plane along an edge thereof. The first feed port may be connected at the centre of the edge or at or towards one side thereof. Having the first feed port connected at a side of the ground plane allows the second radiating element to make full use of the width of the ground plane. However, it also results in a different coupling efficiency between the radiating elements and the ground plane.

In certain embodiments, the second feed port is placed in close proximity to the first feed port. This enables each feed port to be operated independently (ON), or as a driver to the adjacent feed port (Ground), or to be electrically disconnected (OFF). Thus, it is possible to dynamically tune the operating frequency of each radiating element by selecting different modes of operation in relation to each radiating element. The table below provides some possible operating states based on selecting a combination of the above states for the first feed port (Feed Port 1) and the second feed port (Feed Port 2).

TABLE 1

Possible operating states of an embodiment of the present antenna

| State | Mode 1 | Feed Port 1 | Mode 2 | Feed Port 2 |
|---|---|---|---|---|
| 1 | Feed antenna | ON | Parasitic | Ground |
| 2 | Parasitic | Ground | Feed antenna | ON |
| 3 | Feed antenna | ON | Floating | OFF |
| 4 | Floating | OFF | Feed antenna | ON |
| 5 | Feed antenna | ON | Feed antenna | ON |

It will be understood that Mode 1 and Mode 2 represent the operating modes of the first radiating element and the second radiating element, respectively. Accordingly, when a feed port is ON the associated radiating element serves as a driven (or feed) antenna resonating at the frequencies supported by the corresponding impedance-matching circuit. When the feed port is OFF (i.e. electrically disconnected) the associated radiating element is permitted to float (i.e. to resonate at any supported frequency). When the feed port is at Ground the associated radiating element serves as a parasitic element (i.e. resonating at a particular frequency, effectively preventing the other radiating element from supporting that frequency). It will therefore be appreciated that the present invention enables a diverse set of operating modes allowing increased tunability over conventional antenna designs.

In an embodiment of the present invention, the first radiating element may have a tuning range of approximately 0.4 to 3 GHz and the second radiating element may have a tuning range of approximately 1.6 to 3 GHz (or higher).

A single tuning capacitor may be employed to tune each radiating element in each operating mode. The single tuning capacitor may be constituted by a varactor diode.

In certain embodiments three or more radiating elements may be employed to further increase the frequency tuning agility of the antenna. A third or subsequent radiating element may be located within the first gap defined above. The third or subsequent radiating elements may be configured to operate at frequencies greater than 3 GHz.

It will be understood that the merit of the present invention is in an antenna design that enables those knowledgeable in the art to easily configure the antenna to a multitude of operating frequencies. Various impedance-matching circuit configurations can be easily implemented to enable the antenna to operate in both a listening and an application mode.

A parametric study may be undertaken to evaluate the optimum construction of a particular reconfigurable antenna according to an embodiment of the present invention.

According to a second aspect of the present invention there is provided a control module for a reconfigurable antenna comprising a control means for selecting a mode of operation of said antenna from each of the following states: a driven state, a floating state and a ground state; and wherein the driven state is effected through an impedance-matching circuit configured for tuning the frequency band of the antenna.

The impedance-matching circuit may comprise a wideband tuning circuit and/or a narrowband tuning circuit.

According to a third aspect of the present invention there is provided a portable electronic device comprising a reconfigurable antenna according to the first aspect of the invention.

According to a fourth aspect of the present invention there is provided a portable electronic device comprising a control device according to the second aspect of the invention.

BRIEF DESCRIPTION OF THE DRAWINGS

Certain embodiments of the present invention will now be described with reference to the accompanying drawings in which.

DETAILED DESCRIPTION OF CERTAIN EMBODIMENTS

Figure 1:
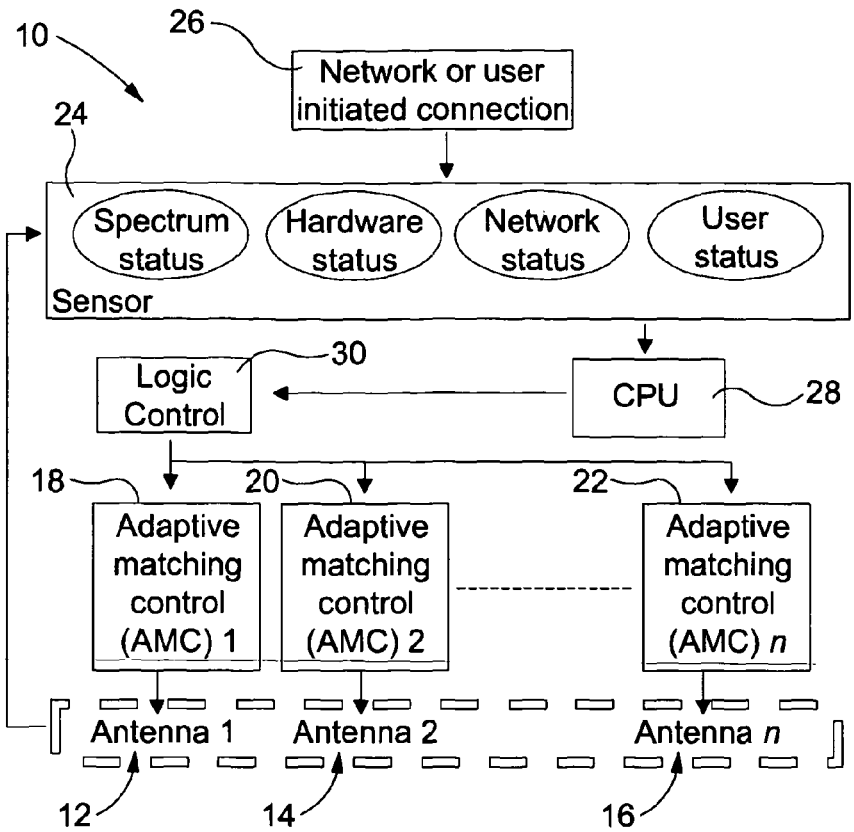
FIG. 1 shows a block diagram illustrating a cognitive radio antenna architecture suitable for use in embodiments of the present invention.
Figure 2A:
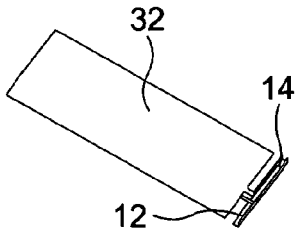
FIG. 2 illustrates the following: (a) a top perspective view of an antenna according to a first embodiment of the present invention; (b) an underneath plan view of said antenna; (c) a top part-perspective view of said antenna; and (d) an underneath part-perspective view of said antenna wherein the radiating elements are shown as if they were translucent.
Figure 2D:
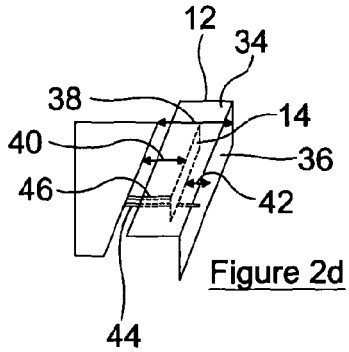
Figure 2B:
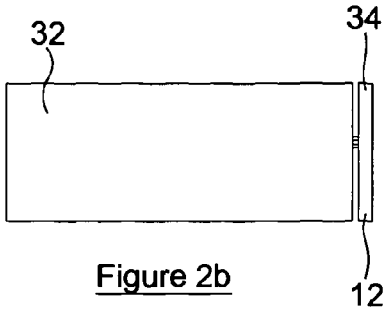
Figure 2C:
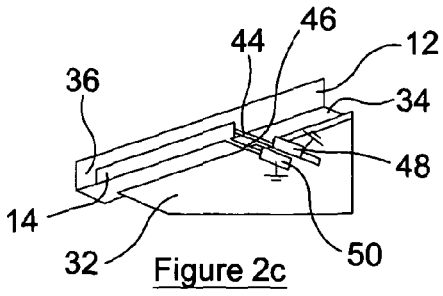

With reference to FIG. 1, there is illustrated a block diagram of a cognitive radio antenna architecture 10 suitable for use in embodiments of the present invention. In the particular embodiment described below, two radiating elements (i.e. two antennas) 12, 14 are employed although, as illustrated, other embodiments may include further antennas 16, as required. Each antenna 12, 14, 16 is connected to an Adaptive Matching Control circuit (AMC) (also referred to as a control module) 18, 20, 22 which includes an impedance-matching circuit for tuning its associated antenna frequency and a means for selecting whether the antenna operates in a driven state, a floating state or a ground state.

The response from each antenna 12, 14, 16 is fed into a sensor 24 which, in this case, is configured to monitor the status of the frequency spectrum, the status of the system hardware, the network status and the user status. Network and/or user initiated connections 26 may therefore feed into the sensor 24.

A central processing unit (CPU) 28 is configured to collect the data provided by the sensor 24 and to feed this into a logic control unit 30. The logic control unit 30 is in turn connected to each of the Adaptive Matching Control circuits (AMC) 18, 20, 22 through which it can instruct the mode of operation of each individual antenna 12, 14, 16 in response to the signals provided by the sensor 24.

FIG. 2 shows in more detail an embodiment of the present invention including some of the components outlined above in relation to FIG. 1. More specifically, FIG. 2 shows an antenna system comprising two radiating elements 12, 14 mounted in close proximity to each other and which are driven over a PCB ground plane 32. Although, in practice, the radiating elements 12, 14 and ground plane 32 are provided on a substrate, no substrate is shown in FIG. 2 for clarity purposes.

In this particular embodiment, the first radiating element 12 is constituted by an L-shaped microstrip patch having a planar portion 34, parallel to the ground plane 32, and an orthogonal portion 36, orthogonal to the ground plane 32. It will be understood that the planar portion 34 will be provided on the opposite side of the substrate from the ground plane 32, laterally spaced therefrom. The orthogonal portion 36 extends from an edge of the planar portion 34 furthest from the ground plane 32 such that the orthogonal portion 36 is spaced from the ground plane 32 by a so-called first gap 38. In this particular embodiment the first gap 38 is less that 10 mm.

The second radiating element 14 is also constituted by a microstrip patch which, in this case, forms a planar rectangle. The second radiating element 14 is also orientated orthogonally to the ground plane 32 and is located within the first gap 38. Thus, the second radiating element 14 is effectively enclosed on two adjacent sides by the L-shaped first radiating element 12. In the embodiment shown, the second radiating element 14 is approximately half the length of the first radiating element 12 and is slightly inset from the edge of the first radiating element 12. The distance between the ground plane 32 and the second radiating element 14 forms a so-called second gap 40. As explained above, the distance between the second radiating element 14 and the orthogonal portion 36 of the first radiating element 12 determines the amount of mutual coupling therebetween. This distance is therefore referred to as the mutual gap 42.

As shown in FIG. 2, each radiating element 12, 14 is connected, respectively, to a first and second control module 48, 50 via a first and second feed port 44, 46. In this particular embodiment, the first and second feed ports 44, 46 are constituted by wires, however, in other embodiments other feed mechanisms could be employed such as microstrip feed lines or non-direct electromagnetic coupling. In this particular embodiment, the first feed port 44 extends between the orthogonal portion 34 of the first radiating element 12 and the first control module 48 situated close to the nearest edge of the ground plane 32, and is located approximately one third of the distance along the length of the first radiating element 12. As described above, this is advantageous in that it allows the ground plane 32 and the first radiating element 12 to support many different resonances.

The second feed port 46 is located adjacent to the first feed port 44 and connects to the adjacent second control module 50. As described above, this enables each feed port 44, 46 and therefore each radiating element 12, 14 to be selectively driven independently, allowed to float, or tied to the ground state. Thus, it is possible to dynamically tune the operating frequency of each radiating element 12, 14 by selecting different modes of operation as outlined in table 1 above.

Figure 3:
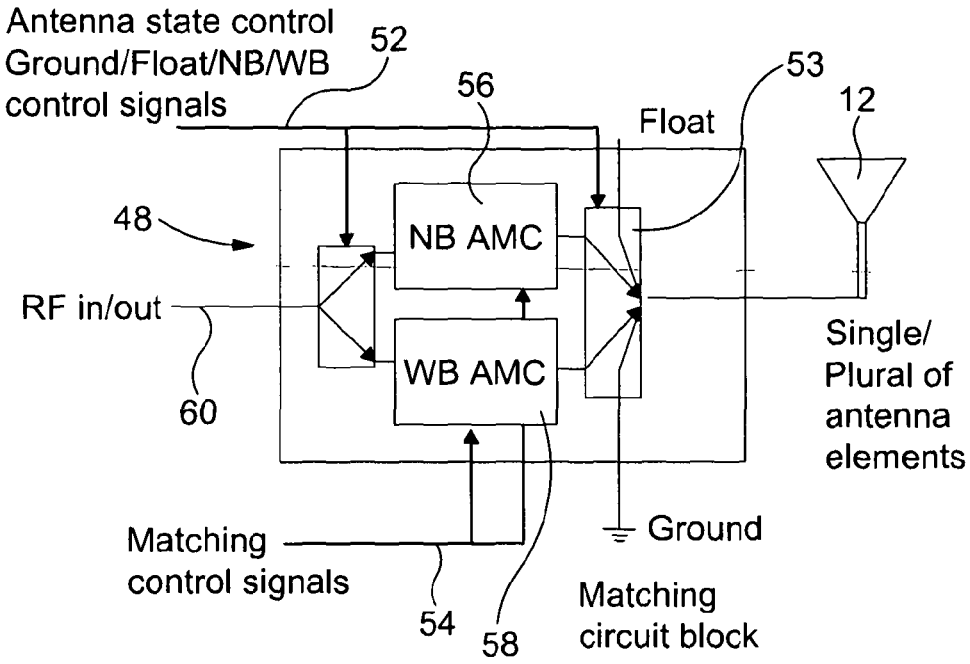
FIG. 3 illustrates schematically a control module according to an embodiment of the present invention.

The functionality of each control module 48, 50 is shown in detail in FIG. 3. Accordingly, the control module 48 is configured to receive operational control signals 52 from the CPU 28 to determine which mode of operation is required. For example, the control signals 52 will determine whether the associated radiating element 12 is to be allowed to float, to be connected to ground, or to be driven in a narrowband (NB) or wideband (WB) mode (and which of the respective Adaptive Matching Circuits (AMC) 56, 58 is therefore to be used). The control module 48 therefore includes a four-way switch 53 to select the appropriate operating mode.

Each AMC 56, 58 contains several stages of impedance-matching circuit configuration as will be described in more detail below. However, it will be understood that any appropriate matching circuitry could be employed such as that commonly known as Pi or Tee, or a combination thereof. Once the required AMC 56, 58 is selected, radio frequency (RF) signals 60 are routed through the appropriate matching stages and control signals 54 are used to drive (or tune) the selected NB/WB AMC 56, 58 to find the desired match.

As mentioned above, the control module 48 is also configured for switching the associated radiating element 12 into a parasitic mode by terminating the antenna input end to ground. It is furthermore capable of removing any connection from the antenna therefore allowing the associated radiating element 12 to float. Thus the present embodiment of the invention enables matching circuits to tune the antenna to a wide and dynamic spectrum of frequencies. Several different matching circuits can be selected to optimise the required band of operation. In the present embodiment, both narrowband and wideband modes of operation are provided for and Tables 2 and 3 below describe some of the permitted operating states and resulting frequency ranges for each mode.

TABLE 2

Narrowband Operating Modes

| Mode | X | Y | Z | Narrow band OUTPUT (MHz) |
|---|---|---|---|---|
| 1 | 0 | 0 | 0 | 800-1200 (port 1), 1700-3000 MHz (port 2) |
| 2 | 0 | 0 | 1 | 800-3000 MHz (Port 1) |
| 3 | 1 | 1 | 0 | 1100-3000 (port 1), 1700-3000 MHz (port 2) |
| 4 | 1 | 1 | 1 | 1100 to >3000 (port 1) |
| 5 | 1 | 0 | 0 | 450-1100 MHz (port 1); 1700-3000 MHz (port 2) |
| 6 | 1 | 1 | 0 | 600-1700 (Port 1) |

TABLE 3

Wideband Operating Modes

| Mode | a | b | 0 | Wideband OUTPUT (MHz) |
|---|---|---|---|---|
| 1 | 0 | 0 | 1 | 490-750 MHz |
| 2 | 1 | 0 | 0 | 780-1300 MHz |
| 3 | 1 | 1 | 0 | 1300-1900 MHz |
| 4 | 0 | 1 | 1 | 1700->3000 MHz |

In the above tables, X, Y and Z (and a, b and 0) represent three different logic states, representing the states of three types of switches in each of the NB and WB AMC's 56, 58.

Figure 4:
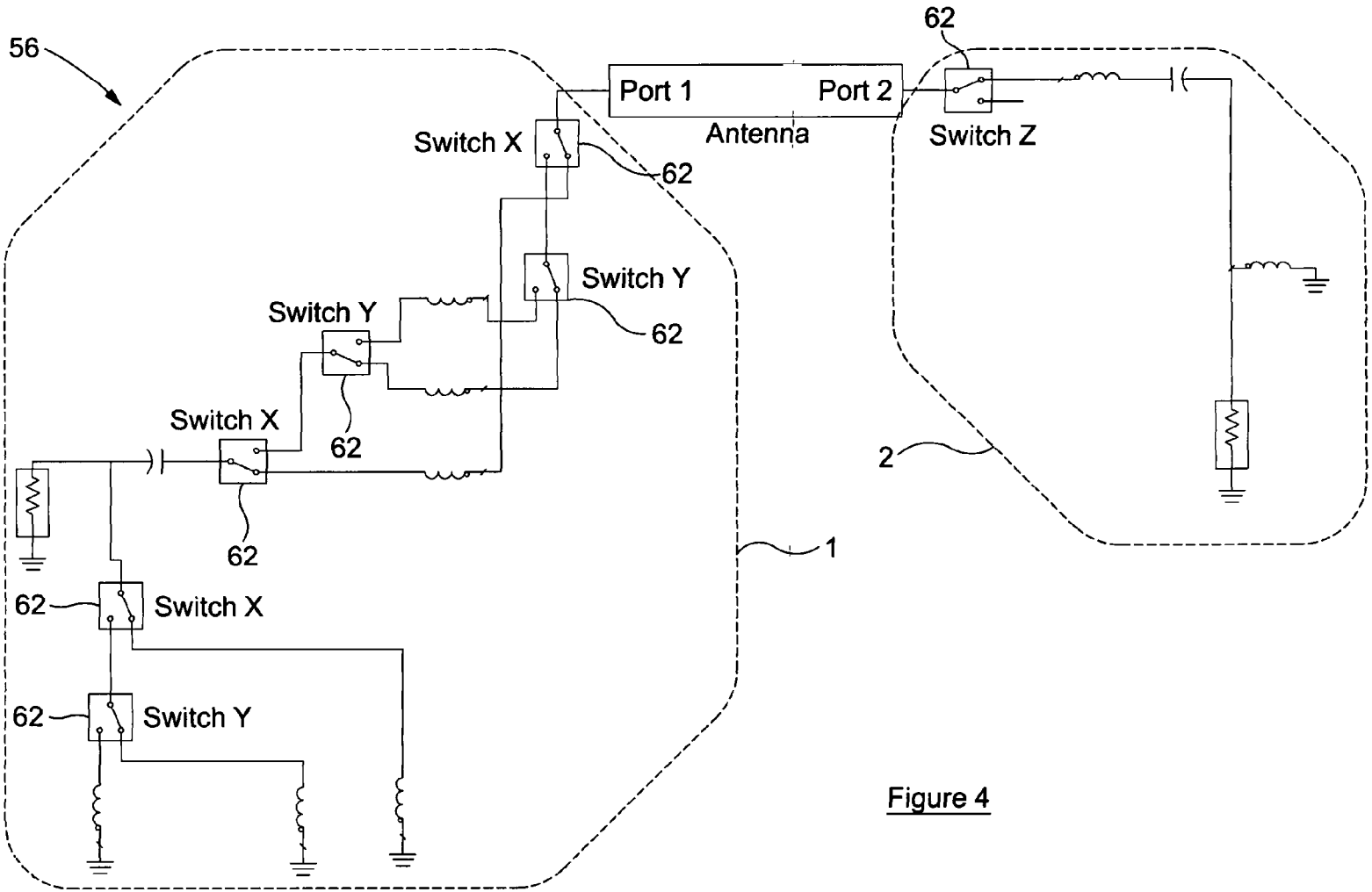
FIG. 4 illustrates a narrowband impedance-matching circuit according to an embodiment of the present invention.

An example of a suitable NB AMC 56 is shown in detail in FIG. 4. Thus, it can be seen that in this embodiment, the left-hand portion of the NB circuit 56, labelled 1, is arranged to drive the first radiating element 12 through Port 1, whilst the right-hand portion of the NB circuit 56, labelled 2, is arranged to drive the second radiating element 14 through Port 2. The NB AMC 56, as illustrated, employs seven single pole double throw (SPDT) switches 62. However, in order to minimise circuit complexity one could employ single pole triple throw switches or single pole quad throw switches in a practical embodiment of the invention. It will be noted that in this particular embodiment, three of the switches 62 are labelled X, a further three are labelled Y, and one is labelled Z and therefore it is the states of each of these sets of switches (X, Y and Z) that determine the operation mode of the antenna, as detailed in Table 2 above. As illustrated in FIG. 4, all of the switches labelled X and Y are in state 1, whilst switch Z is in state 0.

It will also be apparent that the NB AMC 56 includes two tuning capacitors—C4 and C8, each having a tuning range of 0.4 pF to 10 pF. However, it should be noted that only one of the capacitors C4, C8 need be tuned at any one time in order to drive the associated first or second radiating element 12, 14 over a relatively wide range of frequencies.

A number of different narrowband operating modes are now described and their outputs shown in the corresponding Figures. In each of the graphs, Port 1 indicates the response from the first radiating element 12 and Port 2 indicates the response from the second radiating element 14.

Figure 5:
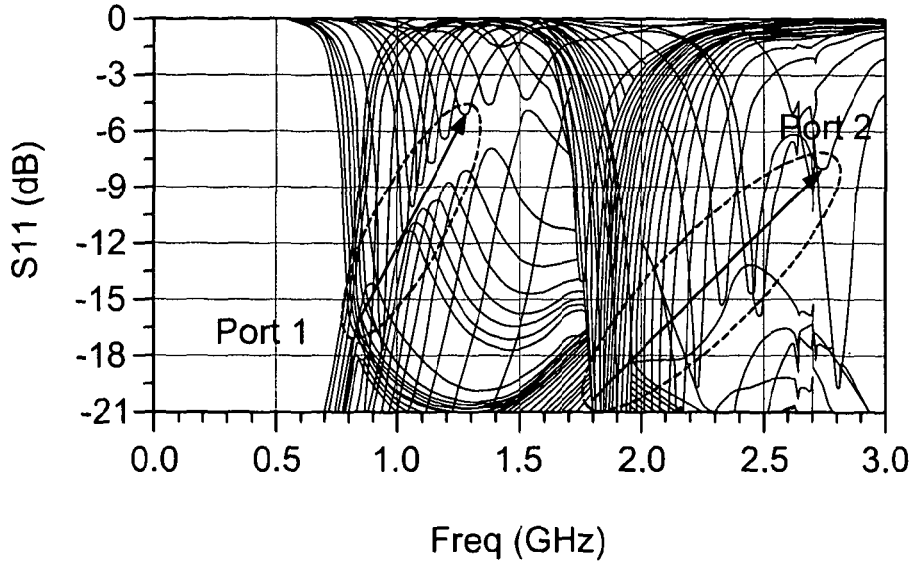
FIG. 5 shows a graph of the frequency tuning range of the two radiating elements employed in the antenna shown in FIG. 2, when both feed ports are on (i.e. driven)

A first operating mode is illustrated in FIG. 5. This shows a graph of the frequency tuning range of the two radiating elements 12, 14 employed in the antenna shown in FIG. 2, when both feed ports are actively tuned (this corresponds to logic state of X=Y=Z=0 in the NB AMC 56).

In this mode, it can be seen that varying the capacitor C4 in portion 1 of the NB AMC 56 from 0.2-8 pF results in the frequency of the first radiating element 12 tuning from 0.8-1.2 GHz. At the same time, varying the capacitor C8 in portion 2 of the NB AMC 56 from 0.2-6 pF results in the frequency of the second radiating element 14 tuning from 1.7-3 GHz. When C4=C8=0.2 pF the first radiating element 12 resonates at 2.8 GHz and the second radiating element 14 resonates at 3 GHz.

Figure 6:
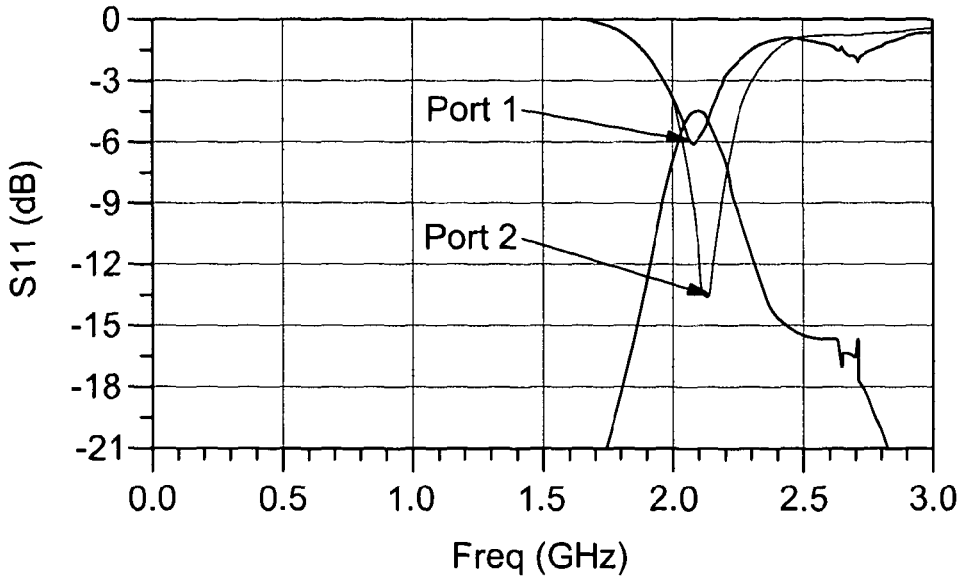
FIG. 6 shows a graph of the two radiating elements operating as a pair of diversity antenna and resonating at the WCDMA2100 downlink band.

With the appropriate, respective, capacitor C4 and C8 values, the antenna may work as a pair of so-called diversity antenna and FIG. 6 shows a graph of the two radiating elements 12, 14 operating as such and resonating at the WCDMA2100 downlink band. This is band commonly used by a diversity receiver in a conventional mobile telephone. As above, this states is achieved when X=Y=Z=0 in the NB AMC 56.

Figure 7:
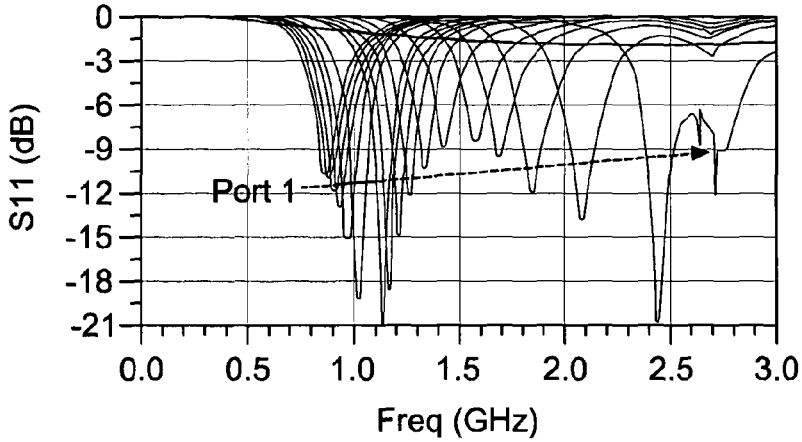
FIG. 7 shows a graph of the frequency tuning range of the first radiating element employed in the antenna shown in FIG. 2, when the first feed port is tuned (i.e. driven) from 0.8 to >3 GHz and the second feed port is allowed to float (i.e. electrically disconnected)

FIG. 7 shows a graph of the frequency tuning range of the first radiating element 12 when portion 1 of the NB AMC 56 is tuned from 0.8 to >3 GHz by varying C4 from 0.2-10 pF, while the second radiating element 14 is electrically disconnected (i.e. allowed to float). This corresponds to logic state X=Y=0, Z=1.

Figure 8A:
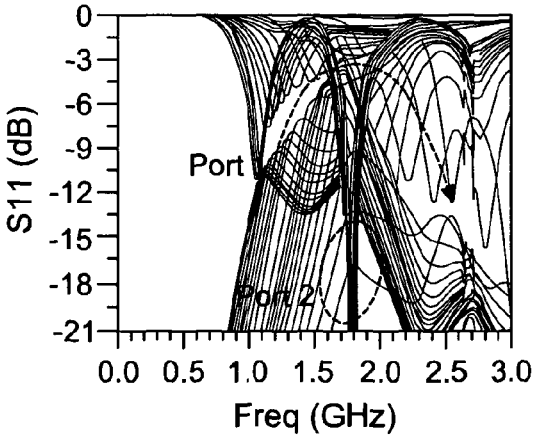
FIG. 8A shows a graph of the frequency range of the two radiating elements employed in the antenna shown in FIG. 2, when the first feed port is tuned (i.e. driven) from 0.8 to >3 GHz and the second feed port is driven at a fixed frequency of 1.7 GHz.
Figure 8B:
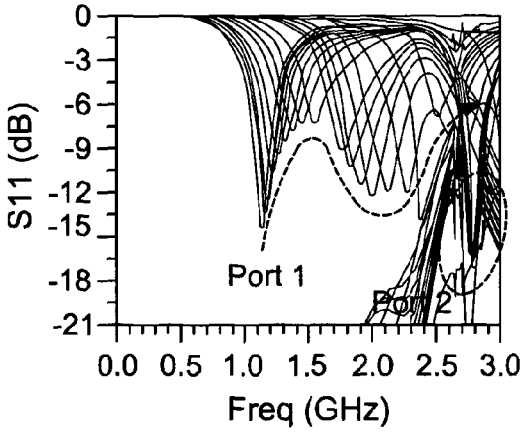
FIG. 8B shows a graph of the frequency range of the two radiating elements employed in the antenna shown in FIG. 2, when the first feed port is tuned (i.e. driven) from 1.1 to >3 GHz and the second feed port is tuned (i.e. driven) from 1.7 to 3 GHz.

FIGS. 8A and 8B show a dual feed mode configuration corresponding to logic state X=Y=1, Z=0. More specifically, FIG. 8A shows a graph of the frequency range of the two radiating elements 12, 14 when portion 1 of the NB AMC 56 is tuned from 0.8 to >3 GHz and portion 2 of the NB AMC 56 is driven at a fixed frequency of 1.7 GHz. FIG. 8B shows a graph of the frequency range of the same two radiating elements 12, 14 when portion 1 of the NB AMC 56 is tuned from 1.1 to >3 GHz and the second feed port is tuned to 2.9 GHz. This implies that the second radiating element 14 has a tuning rage of approximately 1.7 to 3 GHz.

Figure 9:
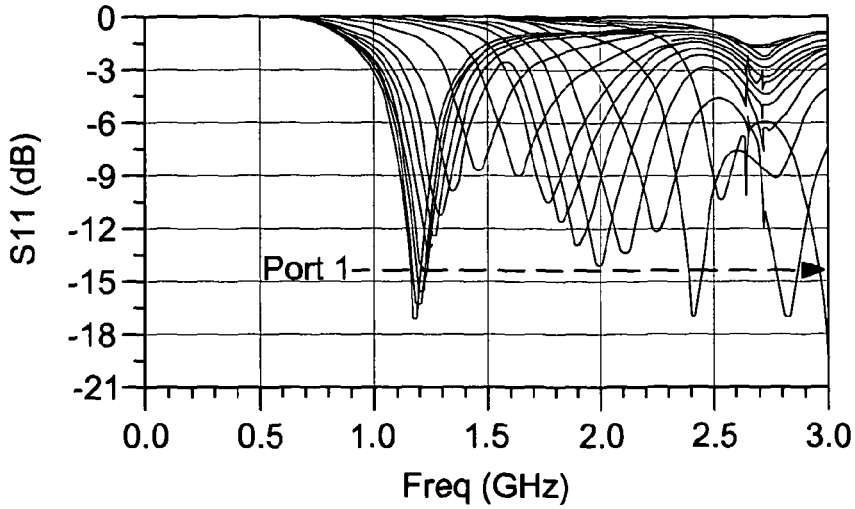
FIG. 9 shows a graph of the frequency range of the first radiating element employed in the antenna shown in FIG. 2, when the first feed port is tuned (i.e. driven) from 1.1 to >3 GHz and the second feed port is allowed to float (i.e. electrically disconnected)

FIG. 9 shows a graph of the frequency range of the first radiating element 12 when portion 1 of the NB AMC 56 is tuned from 1.1 to >3 GHz and the second feed port is allowed to float (i.e. electrically disconnected). This corresponds to logic state X=Y=1, Z=1.

Figure 10A:
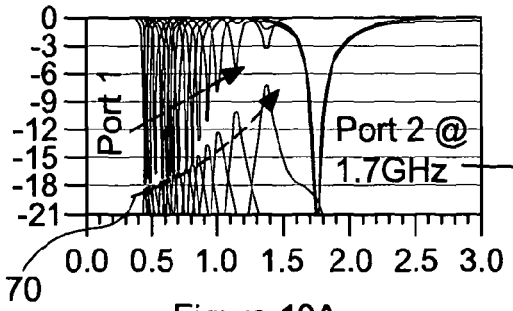
FIG. 10A shows a graph of the frequency range of the two radiating elements employed in the antenna shown in FIG. 2, when the first feed port is tuned (i.e. driven) from 0.46 to 1.2 GHz and the second feed port driven at 1.7 GHz.

FIG. 10A shows a graph of the frequency range of the two radiating elements 12, 14 when portion 1 of the NB AMC 56 is tuned from 0.46 to 1.2 GHz and portion 2 of the NB AMC 56 is driven at 1.7 GHz. The lower sets of curves following the dotted line 70 illustrate the amount of mutual coupling between the two radiating elements 12, 14. Thus, it can be seen that as the frequency of the first radiating element 12 is increased towards the operating frequency of the second radiating element 14, the amount of mutual coupling increases, however, at 1.7 GHz, the mutual coupling level falls to around −18 dB which is very low.

Figure 10B:
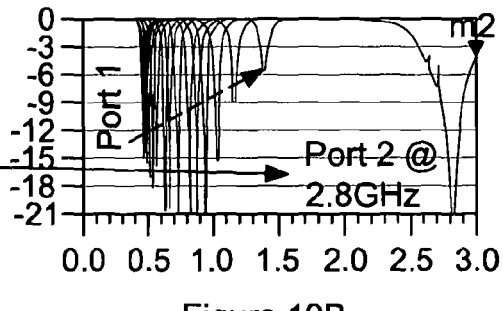
FIG. 10B shows a graph of the frequency range of the two radiating elements employed in the antenna shown in FIG. 2, when the first feed port is tuned (i.e. driven) from 0.46 to 1.2 GHz and the second feed port driven at 2.8 GHz.

FIG. 10B shows a graph of the frequency range of the same two radiating elements 12, 14 when portion 1 of the NB AMC 56 is tuned from 0.46 to 1.2 GHz and portion 2 of the NB AMC 56 is driven at 2.8 GHz. Although not evident from the graph, the amount of mutual coupling between the first and second radiating elements 12, 14 is even lower at 2.8 GHz than at 1.7 GHz. Thus, it is clear that the first and second radiating elements 12, 14 are capable of being tuned independently, without significant effect on the other, from the S-parameter perspective.

It is also apparent from FIGS. 10A and 10B that the higher frequency ranges are more likely to be generated by the second radiating element 14 than the first radiating element 12. The graphs shown in FIGS. 10A and 10B are achieved with the logic states X=1, Y=Z=0.

Figure 11:
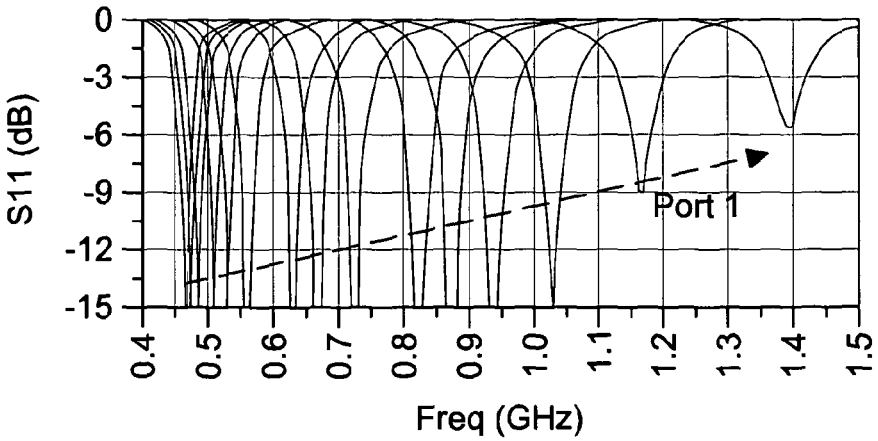
FIG. 11 shows an enlarged portion of the graph of FIG. 10A showing the tuning of the first radiating element from 0.46 to 1.2 GHz.

FIG. 11 shows an enlarged portion of the graph of FIG. 10A showing in more detail the tuning of the first radiating element 12 from 0.46 to 1.2 GHz.

Figure 12:
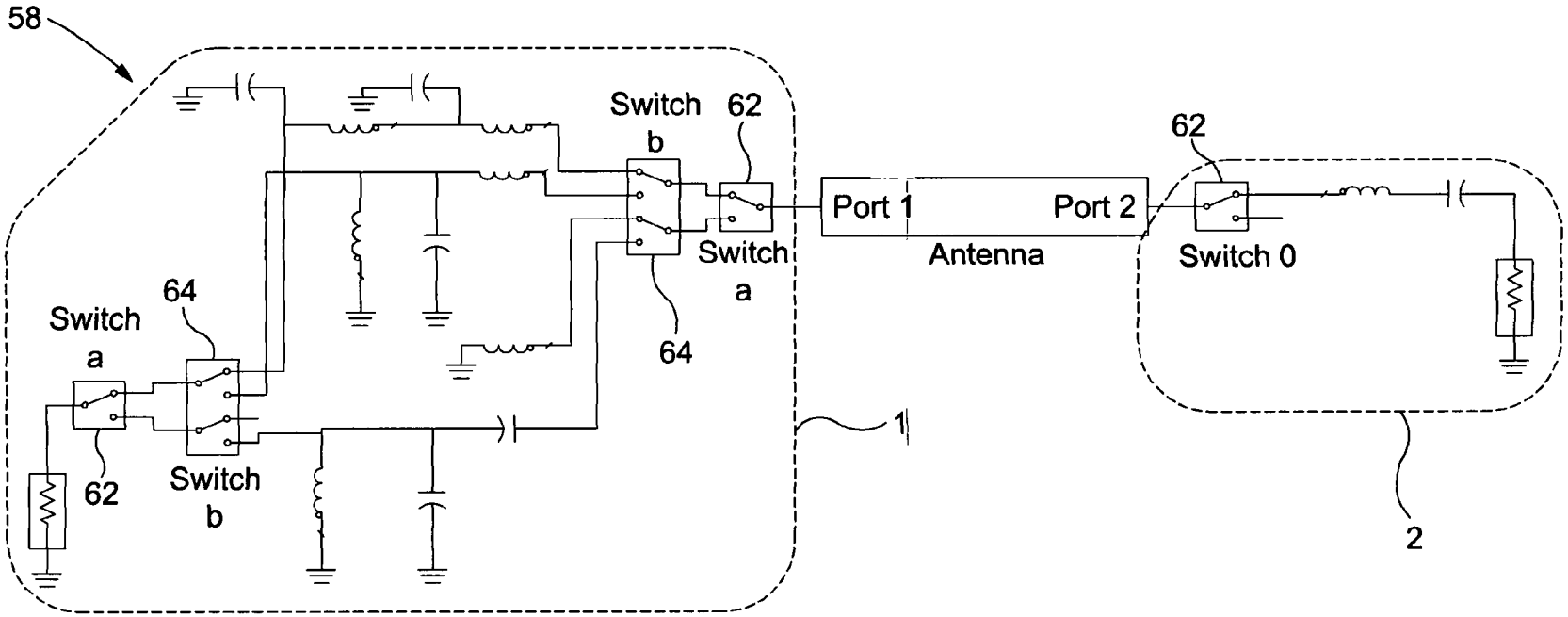
FIG. 12 illustrates a broadband/wideband impedance-matching circuit according to an embodiment of the present invention.

An example of a suitable WB AMC 58 is shown in detail in FIG. 12. Thus, it can be seen that in this embodiment, the left-hand portion of the WB circuit 58, again labelled 1, is arranged to drive the first radiating element 12 through Port 1, whilst the right-hand portion of the WB circuit 58, again labelled 2, is arranged to drive the second radiating element 14 through Port 2. The WB AMC 58 as illustrated, employs three single pole double throw (SPDT) switches 62 and two double pole double throw (DPDT) switches 64. However, in order to minimise circuit complexity one could employ single pole quad throw (SPQT) switches in a practical embodiment of the invention. As referred to in Table 3 above, two of the switches 62 are labelled 'a', two of the switches 64 are labelled 'b', and one further switch 62 is labelled '0', it is therefore the states of each of these sets of switches (a, b and 0) that determine the wideband operational mode of the antenna. As illustrated in FIG. 12, all of the switches a, b and 0 are shown in state 1.

Figure 13:
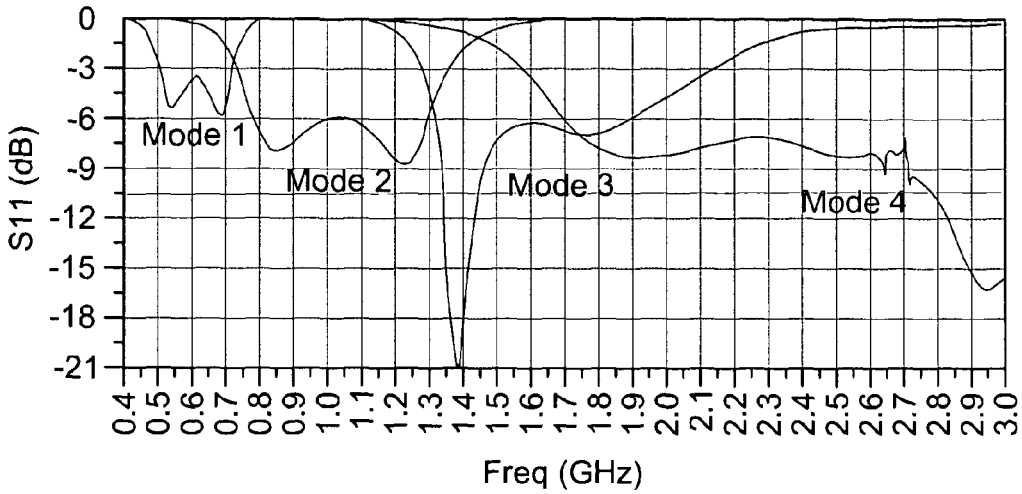
FIG. 13 shows a graph illustrating the frequency ranges for four different wideband modes supported by the impedance-matching circuit of FIG. 12.

FIG. 13 shows a graph illustrating the frequency ranges for the four different wideband modes listed in Table 3. It should therefore be appreciated that the response shown in FIG. 13 is the composite effect resulting when both radiating elements are operated concurrently, in accordance with the logic states provided. It should, however, be noted that other configurations are also possible to extend the wideband frequency range beyond 3 GHz.

It will be understood that using similar switching and matching techniques to those described above will enable antennas according to embodiments of the present invention to be configured for tuning over a wide range of frequencies.

In use, the larger first radiating element 12 primarily resonates at lower band frequencies while the smaller second radiating element 14 primarily resonates at higher band frequencies. The mutual coupling between the two radiating elements 12, 14, in conjunction with the selective operation of the AMC circuits 56, 58 provides the antenna with various tuneable narrow and wideband frequency ranges.

From the above it will be clear that the various aspects of the present invention provide for an antenna system having two or more co-located radiating elements, which occupies a very small volumetric space. More specifically, the embodiment described above and shown in FIG. 2 has dimensions of approximately 48×5×7 mm and is able to dynamically adjust its operating frequency from 400 MHz to >3 GHz in either narrowband or wideband mode. Thus, embodiments of the present invention are ideally compact so as to be able to fit comfortably within typical mobile devices. Furthermore, the tunability of the present antenna is very desirable in the mobile telephone industry particularly when it is realised that the antenna described above comprises a single port quad band device covering all GSM and UMTS2100 bands (i.e. the first radiating element 12) and a second port capable of operating as a receive (RX) diversity for the UMTS2100 band (i.e. the second radiating element 14). It is therefore clear that embodiments of the present invention can be configured as dynamic cognitive radios.

It will be appreciated by persons skilled in the art that various modifications may be made to the above-described embodiments without departing from the scope of the present invention.

The invention claimed is:

1. A reconfigurable antenna comprising two or more mutually coupled radiating elements and two or more impedance-matching circuits configured for independent tuning of the frequency band of each radiating element; and wherein each radiating element is arranged for selective operation in each of the following states: a driven state, a floating state and a ground state; the antenna being provided on a substrate having a ground plane printed on a first side thereof, a first of the radiating elements on a second side of the substrate, opposite the first side thereof, and laterally spaced from the ground plane; and a second of the radiating elements constituted by a planar microstrip patch, orthogonal to the ground plane.

2. The antenna according to claim 1 wherein at least one of the radiating elements is constituted by a non-resonant resonator.

3. The antenna according to claim 2 wherein two non-resonant resonators are employed.

4. The antenna according to claim 1 wherein each radiating element is configured to operate over a wideband and/or a narrowband range of frequencies.

5. The antenna according to claim 1 wherein each impedance-matching circuit comprises a wideband tuning circuit and a narrowband tuning circuit.

6. The antenna according to claim 1, wherein the first radiating element is constituted by an L-shaped microstrip patch, having a planar portion and a portion orthogonal to the ground plane.

7. The antenna according to claim 6 wherein the orthogonal portion extends from an edge of the planar portion furthest from the ground plane such that the orthogonal portion is spaced from the ground plane by a so-called first gap.

8. The antenna according to claim 1, wherein the second radiating element is located between the ground plane and the orthogonal portion of the first radiating element.

9. The antenna according to claim 1, wherein each radiating element has an associated feed port.

10. The antenna according to claim 9 wherein each feed port is connected to a control module comprising a control means for selecting the operating state of the associated radiating element.

11. The antenna according to claim 10 wherein the control means comprises a switch selectively configured to allow the radiating element to float, to be connected to the ground plane or to be driven by its associated impedance-matching circuit.

12. The antenna according to claim 11 wherein a first feed port is provided between the first radiating element and a first control module having a first impedance-matching circuit and a second feed port is provided between the second radiating element and a second control module having a second impedance-matching circuit.

13. The antenna according to claim 12 wherein the first feed port is positioned closer to one side of the radiating element than the other.

14. The antenna according to claim 12 wherein the first feed port is connected to the ground plane along an edge thereof.

15. The antenna according to claim 12 wherein the first feed port is connected to the ground plane at or towards one side thereof.

16. The antenna according to claim 12 wherein the second feed port is placed in close proximity to the first feed port.

17. The antenna according to claim 1 wherein a single tuning capacitor is provided to tune each radiating element in each operating mode.

18. A portable electronic device comprising a reconfigurable antenna according to claim 1.

* * * * *